US005476342A

United States Patent [19]

Allen

[11] Patent Number: 5,476,342

[45] Date of Patent: Dec. 19, 1995

[54] OBSTACLE BYPASS SYSTEM FOR CONCRETE CONSTRUCTION

[76] Inventor: J. Dewayne Allen, 403 Winchester, Paragould, Ark. 72450

[21] Appl. No.: 170,710

[22] Filed: Dec. 21, 1993

[51] Int. Cl.[6] ..... E01C 19/22

[52] U.S. Cl. ..... 404/118

[58] Field of Search ..... 404/97, 114, 118, 404/120

[56] References Cited

U.S. PATENT DOCUMENTS

| | | | |
|---|---|---|---|
| 2,314,985 | 3/1943 | Jackson | 94/45 |
| 2,542,979 | 2/1951 | Barnes | 94/48 |
| 2,651,980 | 9/1953 | Wells | 94/48 |
| 2,693,136 | 11/1954 | Barnes | 94/48 |
| 3,095,789 | 7/1963 | Melvin | 94/45 |
| 4,030,873 | 6/1977 | Morrison | 425/456 |
| 4,105,355 | 8/1978 | King | 404/114 |
| 4,249,327 | 2/1981 | Allen | 404/114 |
| 4,316,715 | 2/1982 | Allen | 425/456 |
| 4,340,351 | 7/1982 | Owens | 425/456 |
| 4,349,328 | 9/1982 | Allen | 425/456 |
| 4,363,618 | 12/1982 | Allen | 425/458 |
| 4,375,351 | 3/1983 | Allen | 425/456 |
| 4,386,901 | 6/1983 | Morrison | 425/456 |
| 4,427,358 | 1/1984 | Stilwell | 425/432 |
| 4,650,366 | 3/1987 | Morrison | 404/114 |
| 4,795,332 | 1/1989 | Davis | 404/118 X |
| 4,798,494 | 1/1989 | Allen | 404/114 |
| 4,818,140 | 4/1989 | Carlson | 404/114 X |
| 4,931,008 | 6/1990 | Morrison | 404/114 X |

*Primary Examiner*—William P. Neuder
*Attorney, Agent, or Firm*—Stephen D. Carver; Trent C. Keisling

[57] ABSTRACT

A concrete placing, screeding and finishing tool that bypasses columns, curbs and other obstacles during concrete finishing. An elongated finishing body comprises retractable bypass wings. The body comprises a front strike-off, a trailing float and a primary eccentrically weighted shaft extending through the body for vibrating it when vigorously rotated, The bypass is coupled to an outer end of the body and may be deployed either in an active position, aligned with the body for finishing concrete, or in a displaced clearance orientation out of contact with the concrete, The bypass comprises a finishing wing, a linkage system and a vibration mechanism, The wing comprises a forward strike-off, a trailing float and a reinforcing tread plate extending from the strike-off to the bull float, The linkage system comprises a bracket secured to an end of the body and a pair of locking, slidable struts extending from the bracket to the wing. Pivot bolts connect the strike-off of the wing to the strike-off of the body and the bull float of the wing to the bull float of the body. The preferred vibration mechanism comprises a secondary, eccentrically weighted shaft for vibrating the wing when rotated and a coupling releasably joining the secondary shaft to the primary shaft when the wing is actively deployed. The coupling comprises semicylindrical primary and secondary shaft ends and a spring biased collar slidably sleeved on one of the shafts for selectively coaxially coupling the semicylindrical ends.

14 Claims, 3 Drawing Sheets

OBSTACLE BYPASS SYSTEM FOR CONCRETE CONSTRUCTION

BACKGROUND OF THE INVENTION

1. Field of the Invention

The present invention relates generally to screeds and strike-offs for placing, screeding, finishing and shaping plastic concrete. More particularly, the present invention relates to a dynamic system for concrete tools that can be selectively extended or retracted to avoid obstacles.

2. The Prior Art

As recognized by those skilled in the concrete finishing arts, after concrete is initially placed during construction, the upper surface must be appropriately finished. The purpose of this finishing is to give the concrete a smooth, homogeneous and correctly textured surface and appearance. Various finishing devices, including screeds, have long been in use throughout the industry for treating plastic concrete. Known prior art systems include "bull" floats, finishing boards, strike-offs, pan floats, plows, blades and the like;

Strike-offs contact rough, freshly placed plastic concrete with a rigid leading edge to initially form and grade fresh concrete. Bull floats essentially comprise a flat wooden board attached to a handle, much like a broom handle. These floats are intended to be manipulated by a single worker. Screeds are elongated tools employing a leading strike-off blade and one or more floats secured to a framework. These screeds allow several finishing steps to be accomplished in a single pass. Forms constrain the concrete until it is set. They may also provide a working support for the typical screed or finishing machine.

The selection of blade design for a particular screed is based upon a variety of factors, such as the characteristics of the concrete being laid. Variables relating to concrete finishing result from the selection of the type and percentage of aggregate, sand, cement, ad-mix and water. Temperature, slab thickness, slump and placement method also vary the application procedure. Those skilled in the art will recognize that the selected finishing equipment must be appropriately matched to the job demands. Thus in screeding, for example, an optimum blade must be chosen based on the condition of the concrete. If high slump concrete is to be screeded, a floating pan would be ideal. For finishing drier concrete, a heavier twin-bladed screed might be more desirable. In all cases it is desirable to provide a method for automatically insuring level finishing.

It is an established fact in the art that vibration facilitates concrete finishing and consolidation. Many vibrating systems are presently in use in the industry. Vibration during screeding helps to settle or consolidate the concrete, thus eliminating air voids. Also, it helps to densify and compact the concrete during finishing. Vibrational screeding also draws out excess water, thereby increasing the cured strength of the placed concrete. A fine layer of component cement and sand aggregate is raised to the surface by vibration along with the excess water. This slurry aids in the subsequent fine finishing of the concrete, promoting the attainment of a uniform product.

I hold several patents in the art of concrete placement and finishing. One such is a prior art, self-propelled "triangular truss" screed that rides upon the aforementioned forms, namely U.S. Pat. No. 4,349,328. Additionally, U.S. Pat. No. 4,798,494 discloses a floating vibratory screed that finishes concrete with or without forms. Finally, prior Allen U.S. Pat. Nos. 4,316,715; 4,363,618 and 4,375,351 and the various references cited and discussed therein are germane to the general technology discussed herein. All the above patents have been assigned to the same assignee as the present case.

U.S. Pat. Nos. 4,650,366 and 4,386,901 disclose screeds capable of formless, self-supporting or floating operation. The latter patent speaks to a relatively heavy triangular truss screed adapted to be operated by two workmen without the use of forms. U.S. Pat. No. 4,650,366 discloses a light weight, portable vibrating screed including a central, extruded beam element.

U.S. Pat. No. 3,431,336 discloses a vibrating finishing screed adapted for use upon plastic concrete that apparently is capable of floating. U.S. Pat. No. 2,314,985 discloses a vibratory hand screed including a central, vibrated pan that is apparently adapted for use upon plastic concrete without support upon confining forms.

Other prior art screeds, generally of the "form-riding" type, include those screeds disclosed in U.S. Pat. Nos. 4,340,351; 4,105,355; 2,651,980; 2,542,979; 3,095,789; 2,693,136; and 4,030,873.

Stilwell, U.S. Pat. No. 4,427,358, discloses a coupling for eccentrically weighted driveshafts for vibratory screeds. This coupling employs a spring biased collar to captivate and join two semicylindrical shaft segments.

An important consideration in planing any job is not only the tools to be used in finishing the concrete but the manpower and logistics of carrying out the work. Concrete must often be placed and finished in relatively confined spaces. For example, the floors within a building are often placed after the majority of the structural elements of the building. Therefore, a contractor may well find it necessary to finish a hallway floor or a floor within a room after the erection of several disruptive structural elements. Oftentimes open areas are interrupted by structural members such as columns or other similar protrusions. Screeds known in the art are generally convertible in length only by breaking the screed down and removing or replacing sections.

Therefore, it is desirous to provide a screed that readily clears obstacles without adding or adjusting sections. It is further advantageous to provide a screed that can bypass columns and obstructions during finishing operations. It is necessary that the bypass readily lock in a deployed position in axial alignment with the rest of the screed and its elements (i.e., strike-off, pan float and/or bull float). The bypass needs to be vibrated when the main sections are vibrated. Therefore, the vibration system of the main screed section must interconnect with the bypass. In the case of screeds vibrated by an eccentrically weighted shaft, the vibrating bypass shaft must be connected to the main screed shaft.

SUMMARY OF THE INVENTION

I have provided an obstacle bypass arrangement for concrete tools that dynamically varies in length to avoid unmovable obstructions. In one form of the invention, it comprises a hinged end section for a screed or the like. It is lockable in an actively deployed position for finishing concrete. When actively deployed, the bypass is axially aligned with the rest of the screed and its elements (i.e., strike-off, pan float and/or bull float). The bypass may also be deployed in a passive position out of contact With the concrete and angularly disposed relative to the main screed to avoid obstacles. My bypass is vibrated by a vibration mechanism linked to a similar vibration mechanism on the main screed. The preferred embodiment of my bypass is vibrated by an eccentrically weighted shaft that is interconnected to the main screed shaft. Alternatively, other conventional, vibratory methods may be employed.

My column bypass comprises a finishing wing, a vibration mechanism and a linkage connecting it to the main screed. The wing comprises an interconnected strike-off and bull float. A pan extending between the bull float and strike-off is employed in some screeds. A bracket on the end of the main screed pivotally mounts the bypass. Bolts and flanges pivotally join the main screed strike-off to the bypass strike-off and the main screed bull float to the bypass bull float. The wing pivots at these bolts between the actively deployed and passively deployed positions. Slidable struts extend from the bull float and the strike-off to the bracket. The wing is locked in position by L-shaped locking bolts passing through slots defined in the slidable struts.

In the preferred embodiment, a secondary driveshaft is mounted in the wing to provide vibration. It is journalled to two pillow bearings mounted on cross pieces extending between the strike-off and the bull float. Eccentric weights on the secondary driveshaft provide the necessary vibration during rotation. The secondary driveshaft is operatively coupled to the primary driveshaft of the main screed. The primary driveshaft and secondary driveshaft have coupled, semicylindrical ends. A spring biased collar sleeves over the coupled semicylindrical ends. The collar is generally tubular with an elongated L-shaped slot. The slot engages a stud extending from the secondary shaft. The collar can be locked when drawn back by twisting it until the stud engages an offset in the slot. This allows the semicylindrical shafts to separate during movement of the wing into the passive position.

Thus a primary object of the present invention is to provide a conveniently operable column bypass system for concrete finishing tools.

A more particular object of the present invention is to provide a column bypass for vibrating screeds that obviates the need for connecting and disconnecting sections.

An object of the present invention is to provide a column bypass that will facilitate finishing plastic concrete in a single pass.

Another object of the present invention is to provide a column bypass of the character described that is adapted to be easily manipulated by workmen with the minimum delay in finishing operations.

Another fundamental object of the present invention is to provide a floating vibrating screed of the character described that may be used with a variety of screed lengths and configurations.

A related object of the present invention is to provide a column bypass that can easily be retrofitted to conventional screeds.

Yet another object of the present invention is to provide a column bypass that may be used in finishing plastic concrete with or without forms.

Still a further object of the present invention is to provide a column bypass of the character described that provides and distributes uniform vibration.

A related object of the present invention is to provide a column bypass that interconnects to the vibration system of the main screed.

A further related object of the present invention is to provide a column bypass mounting an eccentrically weighted secondary shaft adapted to couple with an eccentrically weighted driveshaft associated with the main screed.

A related object is to provide a device suitable for use within a building or in other relatively confined spaces.

An object of the present invention is to provide a bypass that preserves a screed's balance and self-support when resting or moving over plastic concrete.

A similar basic object is to provide an easily operable vibrating screed of the character described adapted to strike-off and float-finish concrete without forms.

Still a further object is to facilitate the formless placement of slabs within existing or partially completed structures.

A similar object is to provide a portable, floating vibrating screed of the character described which may be easily manipulated to avoid obstacles such as columns, pipes, wiring, conduits and the like which might otherwise interrupt or impede conventional screeds.

Still another basic object is to reduce labor costs.

A further object of the present invention is to provide a concrete finishing device that uniformly contacts the plastic concrete surface.

Another object is to provide a device of the character described that is adapted to be easily balanced and self-supporting.

Another object of the present invention is to facilitate the finishing of a great square footage of plastic concrete with a minimum of personnel and with minimal repetitive operations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
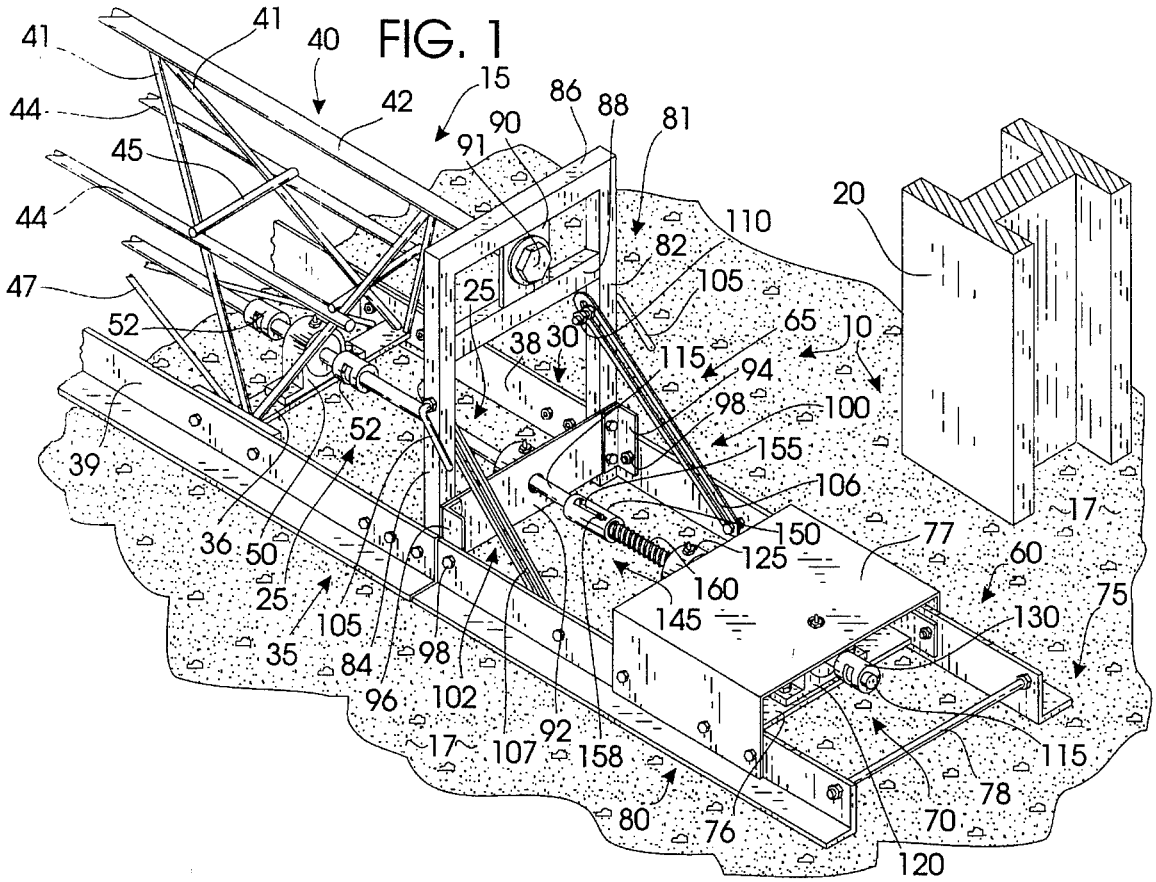
FIG. 1 is a fragmentary, isometric environmental view showing a preferred embodiment of my invention, with the system deployed in an active position approaching an obstacle.
Figure 2:
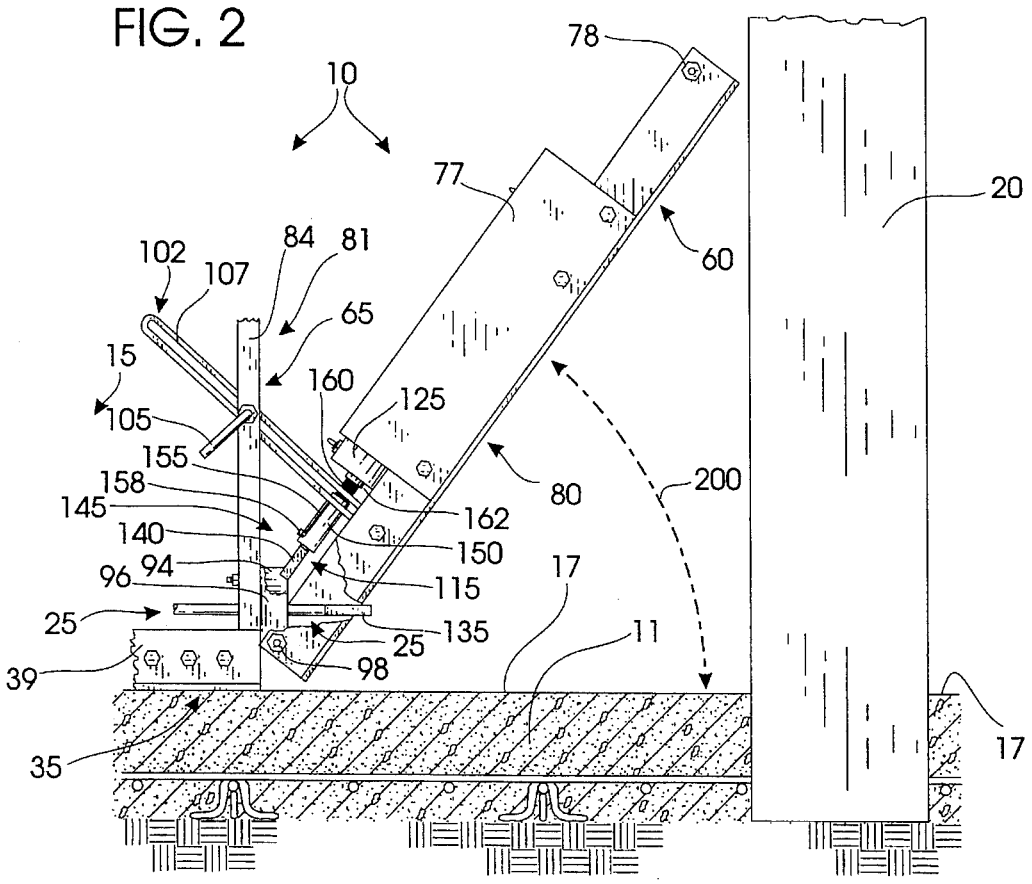
FIG. 2 is an enlarged, partially fragmented, rear elevational view of my system deployed in a clearance orientation, bypassing a column.

With attention now directed to the accompanying drawings my obstacle bypass system for concrete finishing tools is broadly designated by the reference numeral 10. It is attached to the end of an elongated concrete finishing tool such as screed 15 for finishing a slab 11 (FIG. 2). My bypass 10 is intended to be deployed in either an active position, generally axially aligned with the body of the finishing tool 15 (FIG. 1) or displaced in a passive position (FIG. 2). In the passive position the bypass 10 is out of contact with the concrete surface 17 to facilitate clearance of obstacles such as columns 20 or curbs. Preferably my obstacle bypass 10 is vibrated. It employs the same type of vibration mechanism as the main finishing tool 15. The accompanying drawings illustrate my obstacle bypass 10 coupled to a finishing screed 15 vibrated by an eccentrically weighted driveshaft 25. Alternatively, the screed 15 may be vibrated by multiple spaced apart pneumatic or electric vibrators.

The illustrated concrete finishing mechanism is a screed 15 (FIG. 1), but a strike-off, a float, or other form of bladed finishing device may use my obstacle bypass 10. As will be recognized by those skilled in the art, such finishing mechanisms are assembled from several sections at the job site to provide the desired length. The illustrated main screed 15 is a modular unit comprising a strike-Off blade 30 and a bull float 35 (FIG. 1). The strike-off blade 30 initially engages the concrete 17 for initial leveling or "striking-off." The strike-off 30 is secured to the bull float 35 by a cross piece 36 extending between flanges 38, 39 extending upwardly from the strike-off's trailing edge and the bull float's leading edge. Passage of the bull float 35 provides finer finishing of the concrete 17 struck by the strike-off 30. Alternatively, a finishing pan may extend between the bull float 35 and the strike-off 30 to further facilitate finishing of the concrete 17.

The aforementioned cross pieces 36 join the integral triangular-truss screed frame 40 and the concrete finishing elements. The screed frame 40 comprises trusses 41 angularly extending from the intersection of the cross piece 36 and the strike-off or bull float flanges 38, 39 to a frame apex pipe 42. Stringers 44 run generally parallel to the apex pipe 42 while stringer 45 is perpendicular to the apex pipe 42. Both stringers 44, 45 are secured to the trusses 41. Cross braces 47 further reinforce the area between the strike-off 30 and the bull float 35.

Vibration is imparted to the illustrated screed by an eccentrically weighted primary driveshaft 25. A pillow bearing 50 mounted on the cross piece 36 mounts the primary driveshaft 25. The driveshaft 25 is equipped with weighted eccentrics 52 on either side of the bearing 50. When the shaft 25 is vigorously rotated, it imparts vibration to the screed 15 through the pillow bearing 50 and frame member 36, aiding in the compaction and finishing of the plastic concrete 17. Alternatively, multiple spaced apart pneumatic or electric vibrators can be employed to provide vibration.

My obstacle bypass 10 comprises a finishing wing 60, a linkage system 65 and a vibration mechanism 70. The finishing wing 60 comprises a strike-off 75 and a spaced apart bull float 80. Cross pieces 76 extend between the strike-off 75 and the bull float 80, similar to the cross piece 36 of the main screed 15. A tread plate 77 extends from the strike-off 75 to the bull float 80 to reinforce the wing 60 and to cover the vibration mechanism 70. A spreader 78 spans the outboard end of the wing 60 to maintain the strike-off 75 and the bull float 80 in the proper spaced apart relationship. Alternatively, a finishing pan may extend between the bull float 80 and the strike-off 75 to further facilitate finishing of the concrete 17.

The linkage system 65 comprises a bracket 81 secured to the end of the screed's frame 40 to pivotally mount the obstacle bypass 10. The bracket 81 comprises two general vertical uprights 82, 84, a perpendicular header 86 and crossmember 88. A mounting plate 90 secured between the header 86 and the crossmember 88 mounts the apex tube 42 of the screed 15 with a bolt 91. A support 92 extends across the base of the bracket 81.

Two L-shaped flanges 94, 96 extend outwardly from the support 92. Bolts 98 pass through an orifice defined in each of the flanges 94, 96 and a matching orifice defined in the inboard end of the bull float 80 and strike-off 75. The wing 60 pivots at these bolts 98 between the actively deployed position (FIG. 1) and the passively deployed, bypass position (FIG. 2). Slidable struts 100, 102 extend from a mid portion of the bull float 80 and the strike-off 75 to a mid portion of the uprights 82, 84 of the bracket 81. L-shaped locking bolts 105 pass through orifices defined in the bracket up-rights and through slots 106, 107 defined in the slidable struts 100, 102, respectively. Nuts 110 secured to the end of the locking bolts 105 facilitate locking of the wing 60 in the actively deployed or passively deployed positions.

As mentioned above, vibration is provided to the wing 60 by the same type of mechanism 70 employed by the screed 15. In the accompanying drawings a secondary driveshaft 115 mounted in the wing 60 provides this vibration. The secondary driveshaft 115 is generally cylindrical and is mounted in the wing 60 by two pillow bearings 120, 125 mounted on the aforementioned cross pieces 76 extending between the strike-off 75 and the bull float 80.

Figure 6:
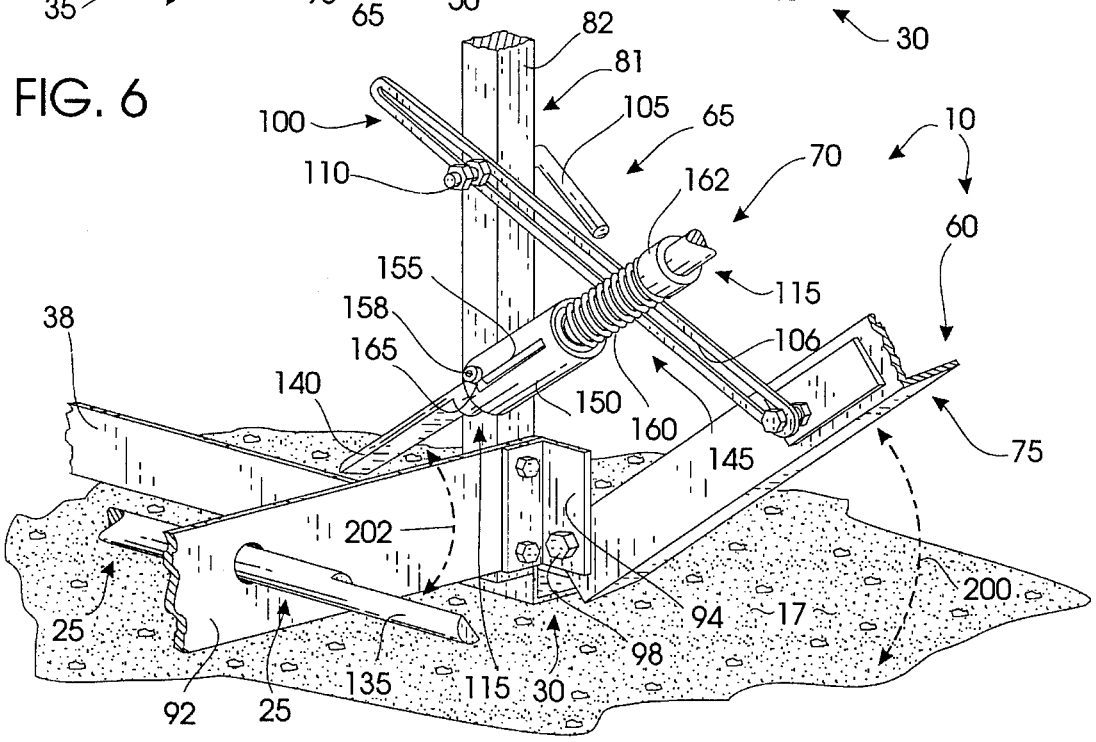

Eccentric weights 130 are secured to the secondary drive shaft 115 to provide the necessary vibration when it is rotated. The secondary driveshaft 115 is operatively coupled to the primary driveshaft 25 of the screed 15. Each driveshaft 25, 115 has a semicylindrical end 135, 140, respectively (FIGS. 2, 6).

When mated, the semicylindrical ends 135, 140 form a continuous, cylindrical surface between the two shafts 25, 115. The coupling 145 comprises a collar 150 which is spring biased to sleeve over the mated semicylindrical ends 135, 140. The collar 150 is generally tubular with an elongated L-shaped slot 155. A stud 158 extending from the secondary shaft 115 engages the slot 155.

A spring 160 biases the collar 150 into engagement with the semicylindrical ends 135,i 140. The spring 160 contacts the collar 150 and a stop 162 secured on the secondary shaft 115 adjacent the inner pillow bearing 125. To disengage the shafts 135, 140 the collar 150 is drawn back against the pressure of the spring 160. It is locked in place by twisting it so the stud 158 will engage the offset 165 in the slot. This will allow the semicylindrical shafts 135, 140 to separate and the wing 60 to be deployed in the passive position (FIG. 6).

Operation

Figure 5:
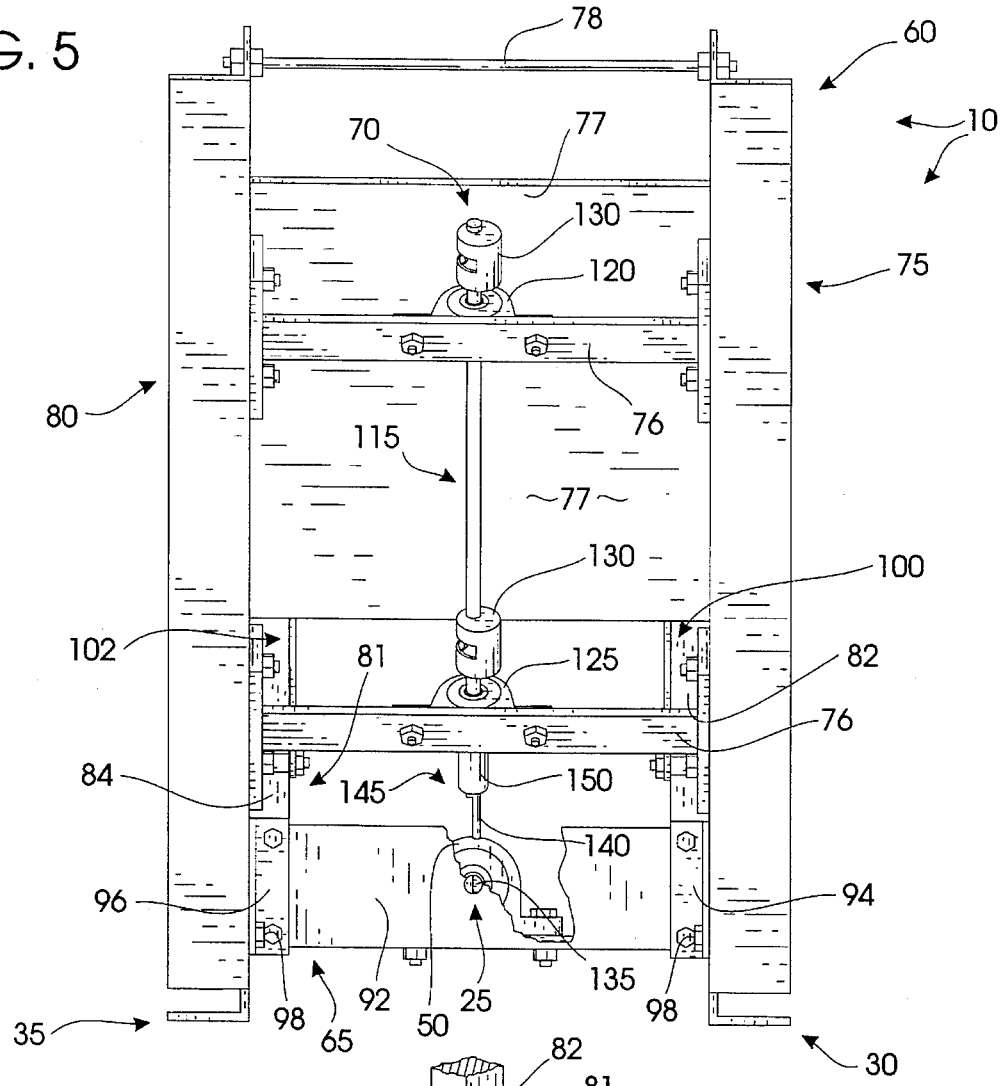
FIG. 5 is a partially fragmented end view of my bypass system deployed in a clearance orientation; and, FIG. 6 is an enlarged, fragmented isometric view of the preferred coupling system for the vibration mechanism of my bypass.

As the screed 15 mounting my obstacle bypass 10 passes over concrete 17 to be finished, the bypass 10 may be displaced to a passive deployment position to allow clearance of obstacles 20 such as columns, protruding wall sections and curbs. To move the bypass to the passive deployment position as illustrated in FIG. 2, 5 and 6, it is necessary to halt the screed 15 and to disengage or shutdown the motor providing rotation to the screed's driveshaft 25.

The spring biased collar 150 over the semicylindrical shaft ends 135, 140 of the primary and secondary driveshafts 25, 115 is drawn back against the spring 160. The collar 150 is then twisted so that the stud 158 engages the offset 165, locking the collar in the withdrawn position. The driveshafts 25, 115 may need to be rotated to provide clearance. The semicylindrical portion 140 of the secondary driveshaft 115 must be positioned to one side or on top of the semicylindrical portion 135 of the primary driveshaft 25. If the semicylindrical portion 135 of the primary driveshaft 25 is on top, the semicylindrical portion 140 of the secondary driveshaft 115 cannot swing clear.

Figure 3:
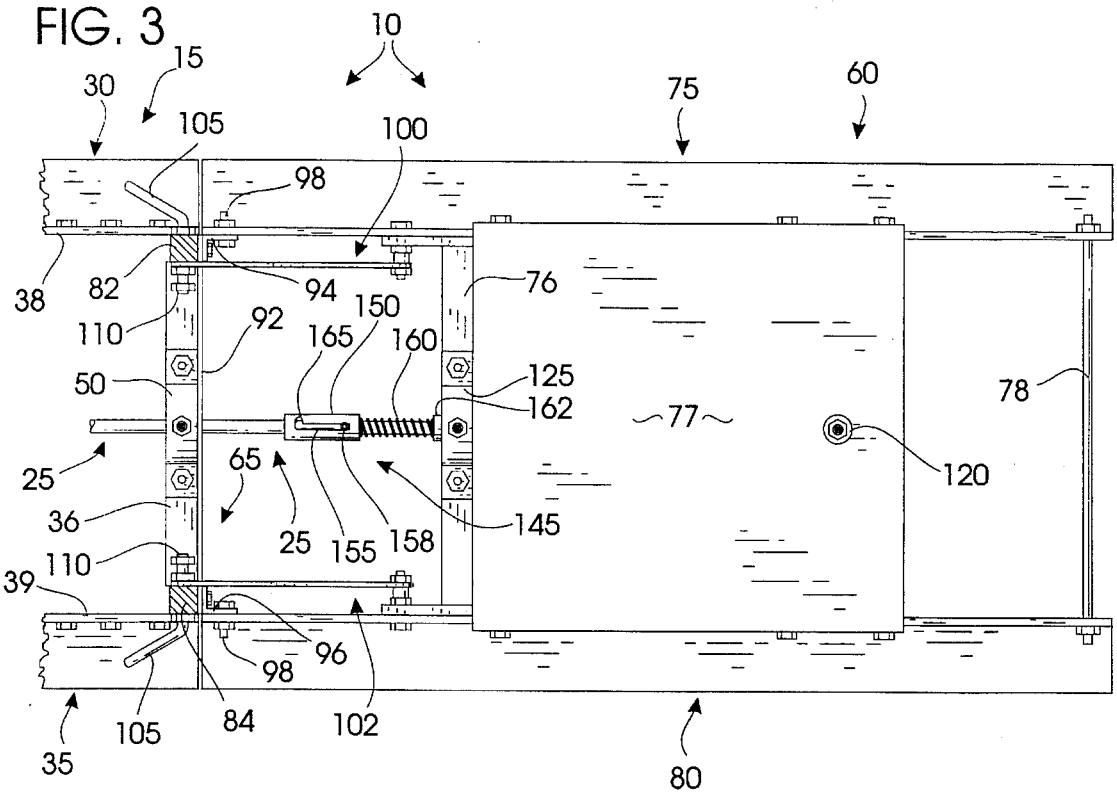
FIG. 3 is a partially fragmented, top plan view of my bypass system deployed in the active position.
Figure 4:
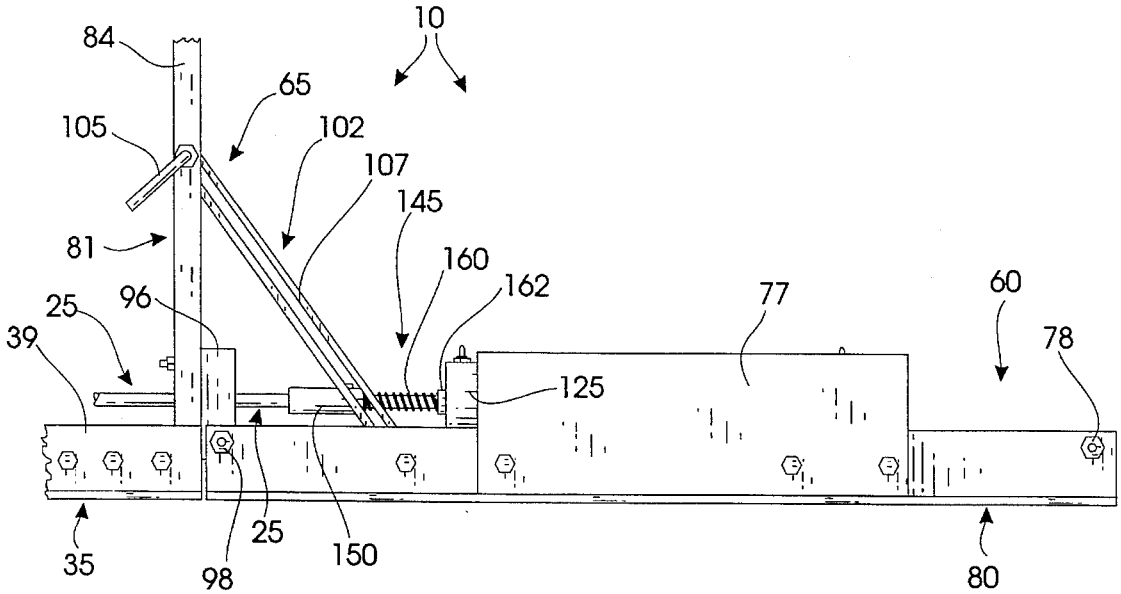
FIG. 4 is a partially fragmented, rear elevational view of my bypass system deployed in the active position.

The L-shaped locking bolts 105 are unscrewed a partial turn to release the slidable struts 100, 102. The wing 60 is then grasped and pivoted about the pivot bolts 98, in an arc 200 (FIGS. 2 and 6) to a passive position out of the way of obstacles 20. The secondary driveshaft 115 will lift upwardly and away from the primary driveshaft 25 as the wing 60 is pivoted, describing an inner arc 202 (FIG. 6). The L-shaped locking bolts 105 are then tightened to retain the wing 60 in the passive position. The end of the secondary driveshaft 115 is maintained clear of the end of the primary driveshaft 20 which is again vigorously rotated to provide vibration for the screed 15. If the screed 15 and bypass 10 are vibrated by pneumatic or electric vibrators it may be necessary to disconnect the lines leading to the vibrators in order to prevent vibration of the wing 60 in the passive potion. The bypass 10 is returned to the active position as illustrated in FIGS. 1, 3 and 4 after the obstacle 20 is cleared, the screed 15 is halted and the vibration motor is disengaged. The L-shaped locking bolts 105 are loosened and the wing 60 is lowered. The Semicylindrical shaft ends 135, 140 are aligned to provide a cylindrical surface. The collar 150 is then twisted to release the offset 165 from the stud 158. The collar 150 sleeves over the semicylindrical ends 135, 140 to couple them in operative engagement. The primary shaft 25 may again be driven to provide vibration to both the screed 15 and the bypass 10.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A concrete finishing tool adapted to bypass obstacles, said tool comprising:

an elongated finishing body for moving over, contacting and finishing plastic concrete, said finishing body comprising:

a strike-off comprising a forward edge of said tool; and a bull float comprising a trailing portion of said tool;

at least one wing coupled to an outer end of said body that may be deployed either in an active position in alignment with said body for finishing said concrete or in a displaced, passive position out of contact with said concrete for clearing obstacles comprising:

a strike-off comprising a forward edge of said tool; and, a bull float comprising a trailing portion of said tool;

means for pivotally connecting said wing to said end of said body comprising:

a bracket secured to said end of said body;

lockably slidable struts extending from said bracket to said wing;

hinge means for pivotally connecting said strike-off of said wing to said strike-off of said body and for pivotally connecting said bull float of said wing to said bull float of said body;

means for vibrating said finishing means to facilitate finishing and densification of said concrete.

2. The tool as defined in claim 1 wherein said means for vibrating said finishing means comprises eccentrically weighted shafts.

3. The tool as defined in claim 1 wherein:

said vibration means comprises a primary weighted shaft extending through said body; and, said wing comprises a secondary weighted shaft and means for releasably coupling said secondary shaft to said primary shaft when said wing is actively deployed.

4. The tool as defined in claim 2 wherein said primary and secondary shafts each terminate in semicylindrical ends that couple when said wing is actively deployed and said coupling means comprises:

a spring biased collar slidably sleeved on one of said shafts for selectively coaxially coupling said semicylindrical ends together, said collar comprising a longitudinal locking slot;

a locking stud extending from the shaft upon which said collar is sleeved, said stud tracking in said slot, said slot comprising an offset portion for selectively captivating said stud, whereby said collar may be twisted to a locked position.

5. The tool as defined in claim 1 further comprising a reinforcing plate extending from said strike-off to said bull float of said wing.

6. A concrete finishing tool adapted to bypass obstacles, said tool comprising:

an elongated finishing body for moving over, contacting and finishing plastic concrete, said finishing body comprising:

a strike-off comprising a forward edge of said tool;

a bull float comprising a trailing portion of said tool; and a primary weighted shaft extending through said body for vibrating said body when vigorously rotated;

at least one wing coupled to an outer end of said body that may be deployed either in an active position in axial alignment with said body for finishing said concrete or in a displaced, passive position out of contact with said concrete for clearing obstacles comprising:

a strike-off comprising a forward edge of said tool;

a bull float comprising a trailing portion of said tool;

a secondary weighted shaft for vibrating said wing when vigorously rotated; and, means for releasably coupling said secondary shaft to said primary shaft when said wing is actively deployed means for pivotally affixing said wing to said end of said body comprising:

a bracket secured to said end of said body;

lockably slidable struts extending from said bracket to said wing;

hinge means for pivotally connecting said strike-off of said wing to said strike-off of said body and for pivotally connecting said bull float of said wing to said bull float of said body.

7. The tool as defined in claim 6 wherein said primary and secondary shafts each terminate in semicylindrical ends that couple when said wing is actively deployed and said coupling means comprises:

a spring biased collar slidably sleeved on one of said shafts for selectively coaxially coupling said semicylindrical ends together, said collar comprising a longitudinal locking slot;

a locking stud extending from the shaft upon which said collar is sleeved, said stud tracking in said slot, said slot comprising an offset portion for selectively captivating said stud, whereby said collar may be twisted to a locked position.

8. The tool as defined in claim 6 further comprising a reinforcing plate extending from said strike-off to said bull float of said wing.

9. A concrete finishing tool for bypassing obstacles, said tool comprising:

elongated finishing means for contacting and finishing plastic concrete, said finishing means adapted to be moved over concrete to be finished;

said finishing means comprising a main body and at least one wing coupled to an outer end of said body that may be deployed either in an active position in alignment with said body for finishing said concrete, or in a displaced, clearance position out of contact with said concrete for clearing obstacles;

means for vibrating said finishing means to facilitate finishing and densification of said concrete; and, means for releasably locking said wing in either substantially axial operative alignment with said body or in said clearance position out of contact with said concrete.

10. The tool as defined in claim 9 wherein said means for vibrating said finishing means comprises eccentrically weighted shafts.

11. The tool as defined in claim 10 wherein:

said vibration means comprises a primary weighted shaft extending through said body; and, said wing comprises a secondary weighted shaft and means for releasably coupling said secondary shaft to said primary shaft when said wing is actively deployed.

12. The tool as defined in claim 11 wherein said primary and secondary shafts each terminate in semicylindrical ends that couple when said wing is actively deployed and said coupling means comprises:

a spring biased collar slidably sleeved on one of said shafts for selectively coaxially coupling said semicylindrical ends together, said collar comprising a longitudinal locking slot;

a locking stud extending from the shaft upon which said collar is sleeved, said stud tracking in said slot, said slot comprising an offset portion for selectively captivating said stud, whereby said collar may be twisted to a locked position.

13. A concrete finishing tool for bypassing obstacles, said tool comprising:

elongated finishing means for contacting and finishing plastic concrete, said finishing means adapted to be moved over concrete to be finished;

said finishing means comprising a main body and at least one wing coupled to an outer end of said body that may be deployed either in an active position in alignment with said body for finishing said concrete, or in a displaced, clearance position out of contact with said concrete for clearing obstacles;

means for vibrating said finishing means to facilitate finishing and densification of said concrete, said vibration means comprises a primary weighted shaft extending through said body;

said wing comprises a secondary weighted shaft and means for releasably coupling .said secondary shaft to said primary shaft when said wing is actively deployed; and, means for releasably locking said wing in either substantially axial operative alignment with said body or in said clearance position out of contact with said concrete.

14. The tool as defined in claim 13 wherein said primary and secondary shafts each terminate in semicylindrical ends that couple when said wing is actively deployed and said coupling means comprises:

a spring biased collar slidably sleeved on one of said shafts for selectively coaxially coupling said semicylindrical ends together, said collar comprising a longitudinal locking slot;

a locking stud extending from the shaft upon which said collar is sleeved, said stud tracking in said slot, said slot comprising an offset portion for selectively captivating said stud, whereby said collar may be twisted to a locked position.

* * * * *